US009193512B2

(12) United States Patent
Brooks

(10) Patent No.: US 9,193,512 B2
(45) Date of Patent: Nov. 24, 2015

(54) BAG IN BOX PACKAGING

(71) Applicant: Scholle Corporation, Irvine, CA (US)

(72) Inventor: John Brooks, Leabrook (AU)

(73) Assignee: SCHOLLE CORPORATION, Northlake, IL (US)

( * ) Notice: Subject to any disclaimer, the term of this patent is extended or adjusted under 35 U.S.C. 154(b) by 116 days.

(21) Appl. No.: 14/031,612

(22) Filed: Sep. 19, 2013

(65) Prior Publication Data

US 2014/0076927 A1 Mar. 20, 2014

Related U.S. Application Data

(60) Provisional application No. 61/702,914, filed on Sep. 19, 2012.

(51) Int. Cl.
*B65D 35/56* (2006.01)
*B65D 77/06* (2006.01)

(52) U.S. Cl.
CPC ..... *B65D 77/068* (2013.01); *B65D 77/067* (2013.01)

(58) Field of Classification Search
CPC .. B65D 76/065; B65D 76/067; B65D 76/068; B65D 7/065; B65D 77/067; B65D 77/0687
USPC ..... 222/105; 229/117.3, 117.32, 117.15, 229/125.42
See application file for complete search history.

(56) References Cited

U.S. PATENT DOCUMENTS

| | | | | |
|---|---|---|---|---|
| 36,478 | A | 9/1862 | Phelps | |
| 3,173,579 | A * | 3/1965 | Curie et al. | 222/105 |
| 3,363,807 | A * | 1/1968 | Powell | 222/105 |
| 4,169,548 | A | 10/1979 | Bond | |
| 4,174,051 | A | 11/1979 | Edwards et al. | |
| 4,314,654 | A | 2/1982 | Gaubert | |
| 4,322,018 | A | 3/1982 | Rutter | |
| 4,355,737 | A | 10/1982 | Pongrass et al. | |
| 4,475,670 | A | 10/1984 | Rutter | |
| 4,493,438 | A | 1/1985 | Rutter | |
| 4,572,422 | A | 2/1986 | Heuberger et al. | |
| 4,722,458 | A | 2/1988 | VanDal | |
| 4,919,306 | A | 4/1990 | Heaps et al. | |
| 5,014,888 | A * | 5/1991 | Bryan | 222/541.5 |
| 5,048,691 | A * | 9/1991 | Heuberger et al. | 229/117.3 |
| 6,756,069 | B2 | 6/2004 | Scoville | |
| 8,225,958 | B2 | 7/2012 | Nielsen et al. | |

(Continued)

FOREIGN PATENT DOCUMENTS

| | | |
|---|---|---|
| EP | 1868916 B1 | 4/2010 |
| FR | 2897848 A1 | 8/2007 |
| WO | 2006096510 A1 | 9/2006 |

*Primary Examiner* — Daniel R Shearer

(74) *Attorney, Agent, or Firm* — The Watson I.P. Group, PLC; Jovan N. Jovanovic; Vladan M. Vasiljevic

(57) ABSTRACT

An outer box for a bag in box packaging includes a plurality of walls and an articulatable portion. The articulatable portion is hingedly coupled to each of the dispensing wall, the first sidewall and the second sidewall. The articulatable portion also includes a front portion, a first side webbing and a second side webbing. Inward rotation of the front portion causes the first and second panels of each of the first and second side webbing to rotate about a respective one of the central folds thereof. An outer surface of each of the first and second panels face each other, with the articulated portion overlying a portion of the first panel of each of the first side webbing and second side webbing.

18 Claims, 7 Drawing Sheets

(56) References Cited

U.S. PATENT DOCUMENTS

| | | | | |
|---|---|---|---|---|
| 8,556,124 | B2 * | 10/2013 | Edwards | 222/105 |
| 8,672,184 | B2 * | 3/2014 | Edwards | 222/105 |
| 8,746,541 | B2 * | 6/2014 | Spivey et al. | 229/117.3 |
| 2003/0183650 | A1 | 10/2003 | Muise et al. | |
| 2008/0210584 | A1 | 9/2008 | Barthel et al. | |
| 2009/0084834 | A1 | 4/2009 | Duyst | |
| 2009/0159594 | A1 | 6/2009 | Nielsen et al. | |
| 2010/0038386 | A1 * | 2/2010 | Pritchard | 222/522 |
| 2011/0036864 | A1 | 2/2011 | McKenna | |
| 2011/0259916 | A1 * | 10/2011 | Spivey et al. | 222/105 |
| 2012/0217265 | A1 | 8/2012 | Edwards | |
| 2012/0217266 | A1 | 8/2012 | Edwards | |

* cited by examiner

BAG IN BOX PACKAGING

CROSS-REFERENCE TO RELATED APPLICATION

This application claims priority from U.S. Provisional Patent Application Ser. No. 61/702,914 filed Sep. 19, 2012, entitled "Bag-in-Box Packaging," the entire disclosure of which is hereby incorporated by reference.

BACKGROUND OF THE DISCLOSURE

1. Field of the Disclosure

The disclosure relates in general to bag in box packaging, and more particularly, to a bag in box packaging that has an articulatable portion to which the tap is affixed.

2. Background Art

The use of bag in box packaging is ubiquitous. In certain applications, a user can dispense flowable material through a tap directly from the bag in box packaging. One such application is wine dispensing, although, the invention is not limited to the same.

Conventionally, a bag having a fluid therewithin (such as, for example, wine) is provided. A tap is provided over a spout that is welded to the bag. The tap may comprise any number of different spouts that are conventionally used in such an application. The filled bag is dropped into an outer box. The outer box includes a removable portion which corresponds to the location of the tap within the outer box.

To access the tap, the user punctures the box proximate the removable portion and reaches into the box for the tap. The tap is then directed out of the box and one of the tap and the spout are coupled to the box. The tap can then be actuated to dispense product.

Problematically, for some users it is difficult to couple the tap to the outer box. Thus, the tap becomes difficult, if not impossible to use. In other instances, the tap may become dislodged from the outer box during use.

In addition, due to the manner in which the tap and bag are inserted into the outer box, there are many instances where the tap lies in an orientation which is difficult to reach. Furthermore, inasmuch as the opening in the box is typically used to secure the tap to the outer box, the opening is often too small to allow for a user to delve deeply into the outer box.

SUMMARY OF THE INVENTION

In one aspect of the disclosure, the disclosure is directed to a bag in box packaging comprising an outer box and an inner bag. The outer box has a top wall, a bottom wall, a first side wall, a second sidewall opposite the first sidewall, and a dispensing wall. The dispensing wall spans between the top wall and the bottom wall, and between the first sidewall and the second sidewall. The articulatable portion is hingedly coupled to each of the dispensing wall, the first sidewall and the second sidewall. The articulatable portion further includes a front portion, a first side webbing and a second side webbing. The front portion extends from the dispensing wall and is hinged thereto at a top edge. The first side webbing spans between the first sidewall and the dispensing wall. The second side webbing spans between the second sidewall and the dispensing wall on the opposite side of the front portion. The first side webbing has a first panel and a second panel. The first panel is joined to the first sidewall at a first edge, and is joined to the second web at a central fold. The second panel is joined to the front portion opposite the center fold at a second edge. The second side webbing has a first panel and a second panel. The first panel is joined to the second sidewall at a first edge and is joined to the second web at a central fold. The second panel is joined to the front portion opposite the center fold at a second edge. Upon inward rotation of the front portion, the first and second panels rotate about a respective one of the central folds with an outer surface of each of the first and second panels facing each other. Additionally, the articulated portion overlies a portion of the first panel of each of the first side webbing and second side webbing.

The inner bag has a plurality of panels that are sealed to form a substantially fluid tight cavity. A spout is coupled thereto to provide ingress into the cavity. A tap is coupled to the spout. The inner bag is positioned within the outer box, and the tap is extended through an opening in the front portion of the articulatable portion so as to be accessible therefrom.

In a preferred embodiment, an outer cap is coupled to the outer box so as to cover the articulatable portion from the collapsed orientation to the articulated configuration, with an opening to receive the tap when in the articulated configuration.

In another preferred embodiment, the articulatable portion extends between an articulated configuration wherein the front portion of the articulatable portion is substantially coplanar with the dispensing wall to a collapsed orientation wherein the adjustable portion is inwardly rotated so as to be oblique to the dispensing wall.

In another preferred embodiment, the articulatable portion defines an effective width. Rotation of the articulatable portion from the articulated configuration to the collapsed orientation increases the effective width until the effective width is wider than a distance between the first side wall and the second sidewall proximate the articulatable portion. This, in turn, defines a local maximum width. Further inward rotation outwardly forces at least one of the first and second side walls until the effective width is less than or equal to the distance between the first side wall and the second side wall.

In another preferred embodiment, the first and second side wall maintain the articulatable portion in a collapsed orientation proximate a local maximum width.

In another preferred embodiment, at a local maximum width, the front portion of the articulatable portion is angled relative to the dispensing wall at an angle of approximately between 20° and 60°.

In another preferred embodiment, front portion of the articulatable portion defines a trapezoidal configuration.

In another preferred embodiment, the first edge of the first side webbing, the central fold of the first side webbing and the second edge of the first side webbing and the top edge of the front portion meet at a corner.

In another embodiment, the first edge of the second side webbing, the central fold of the second side webbing and the second edge of the second side webbing and the top edge of the front portion meet at a corner.

In some such embodiments, the first side webbing and the second side webbing are substantially identical mirror images of each other.

In another such embodiment, the tap is positioned centrally on the front portion of the articulatable portion between the first side webbing and the second side webbing.

In yet another preferred embodiment, the articulatable portion is formed from portions of the first sidewall, second sidewall and the dispensing wall. In some such embodiments, the articulatable portion is formed from substantially the entirety of the dispensing wall.

Preferably, the front portion further includes a locking flap extending from a bottom edge thereof, the locking flap configured to extend over an inner surface of the first side webbing and the second side webbing, so as to maintain a collapsed configuration.

In another aspect of the disclosure, the disclosure is directed to an outer box for a bag in box packaging, and has the features specified above with respect to the outer box.

In a preferred embodiment, an outer cap is removably positionable over the articulatable portion. The outer cap is coupled to the outer box and has an opening on a front wall thereof configured to provide access to a tap positioned therein.

BRIEF DESCRIPTION OF THE DRAWINGS

The disclosure will now be described with reference to the drawings wherein.

DETAILED DESCRIPTION OF THE DISCLOSURE

Figure 1:
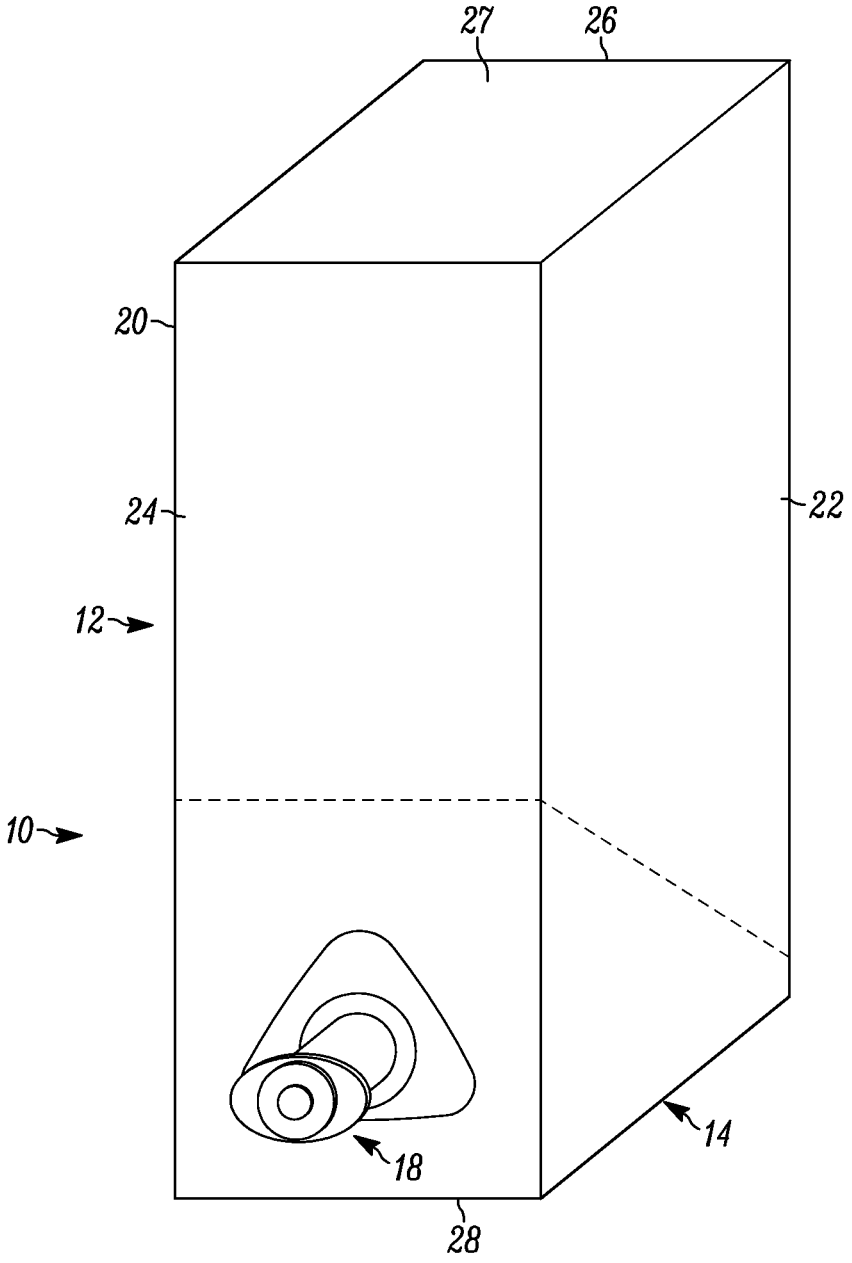
FIG. 1 of the drawings is a perspective view of an embodiment of the bag in box package of the present disclosure.

While this invention is susceptible of embodiment in many different forms, there is shown in the drawings and described herein in detail a specific embodiment with the understanding that the present disclosure is to be considered as an exemplification and is not intended to be limited to the embodiment illustrated.

It will be understood that like or analogous elements and/or components, referred to herein, may be identified throughout the drawings by like reference characters. In addition, it will be understood that the drawings are merely schematic representations of the invention, and some of the components may have been distorted from actual scale for purposes of pictorial clarity.

Referring now to the drawings and in particular to FIG. 1, bag in box packaging of the present disclosure is shown generally at 10. The bag in box packaging of the present disclosure is typically well suited for use in association with any number of different industries and for carrying any number of different flowable materials. For example, the packaging is particularly well suited for use in association with the wine industry, for what is known as bag in box wine. Other particular uses include edible oils, fertilizers, additives, detergents and the like. The packaging is not limited for use in association with any particular type of industry or for any particular flowable material. Indeed, these foregoing examples are meant to be exemplary only, and are not intended to limit the disclosure in any manner.

Figure 2:
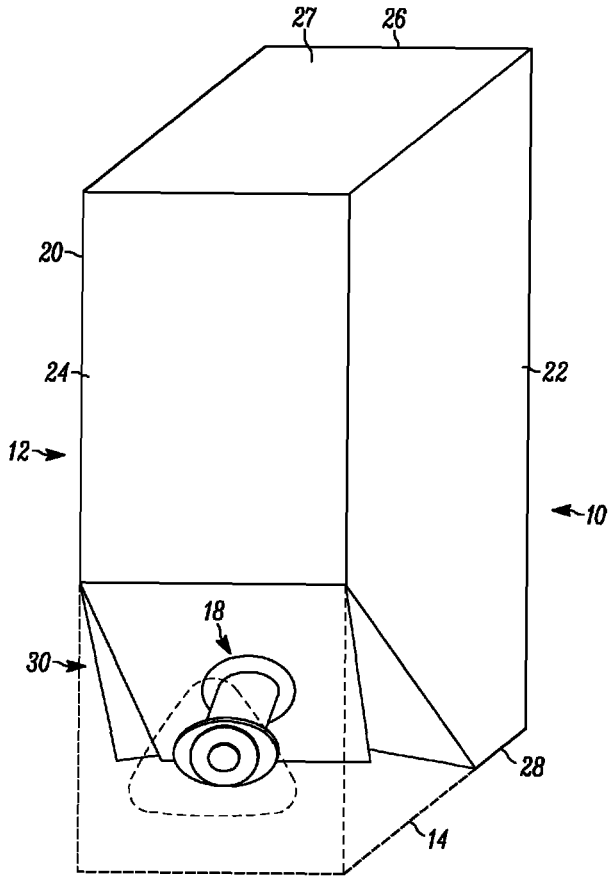
FIG. 2 of the drawings is a partial perspective view of an embodiment of the bag in box packaging of the present disclosure.

The bag in box packaging 10 of FIGS. 1 and 2 further includes outer box 12, outer cap 14, inner bag 16 (FIG. 3) and tap 18. The outer box 12 comprises a generally rectangular cubic configuration. Typically, the outer box 12 is formed from a corrugated paperboard which may be formed from a single blank, or which may be formed from a plurality of discrete panels or pieces of material that are coupled together. The outer box 12 typically comprises a single layer corrugated material. A decorative outer layer of printed material may be presented on the outer surface of the outer box. In other embodiments, the outer box may comprise a polymer based outer container, formed from, for example, a corrugated polymer material. Generally, the configuration of the container is often dictated by design considerations, and the invention is not limited to any particular container shape, except insofar as the structural features of the articulated portion are met. A number of different shapes have been contemplated for bag in box packaging, included but not limited to more circular cross-sectional shapes, polygon cross-sectional shapes, square cross-sectional shapes and rectangular cross-sectional shapes.

The particular outer box 12 of the present disclosure includes first sidewall 20, second sidewall 22, dispensing wall 24, back wall 26, top wall 27 and bottom wall 28. In the embodiment, portions of the dispensing wall, the first sidewall 20 and the second sidewall 22, as well as a portion of the bottom wall 28 cooperate to form the articulatable portion 30. It will be understood that the first sidewall 20 and the second sidewall 22 are spaced apart from each other a substantially uniform distance so as to be substantially parallel to each other. Spanning between the two walls, the dispensing wall 24 and the back wall 26 extend substantially perpendicular to the sidewalls and substantially parallel to each other. Finally, the top wall and the bottom wall are substantially parallel to each other and substantially perpendicular to the other two walls. In the embodiment shown, the sidewalls are a bit wider than the remaining walls so that a rectangular cross-section is defined. The largest dimension of the container is the height of the sidewalls and the dispensing wall and the back wall. Of course, in other embodiments, the size of the different walls can be altered, as can the overall shape of the outer box.

Figure 7:
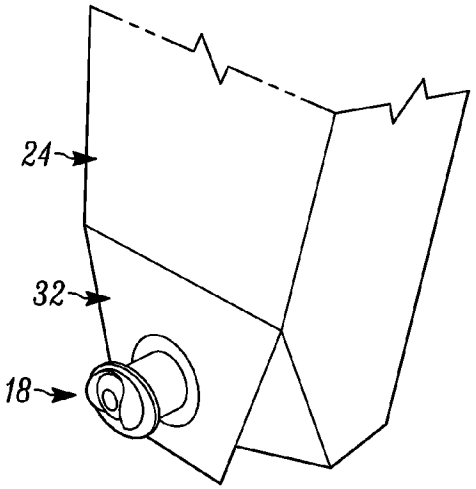
FIG. 7 of the drawings is a partial perspective view of a portion of the outer box of the present disclosure, showing, in particular, the articulatable portion in an articulated configuration.
Figure 8:
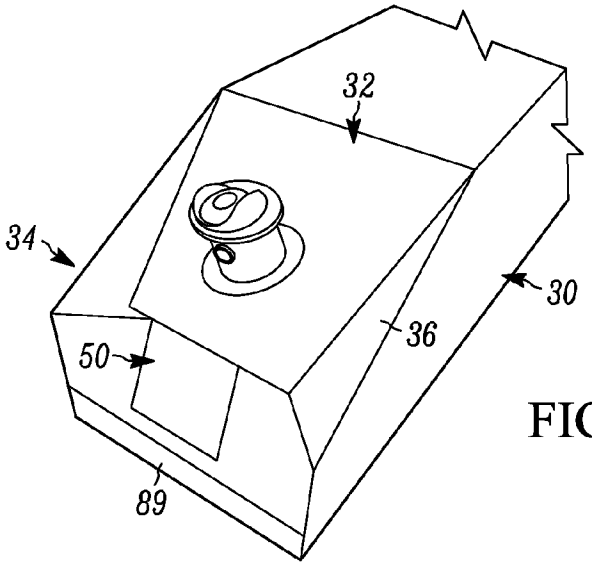
FIG. 8 of the drawings is a partial perspective view of a portion of the outer box of the present disclosure, showing, in particular, the articulatable portion in a collapsed configuration.
Figure 6:
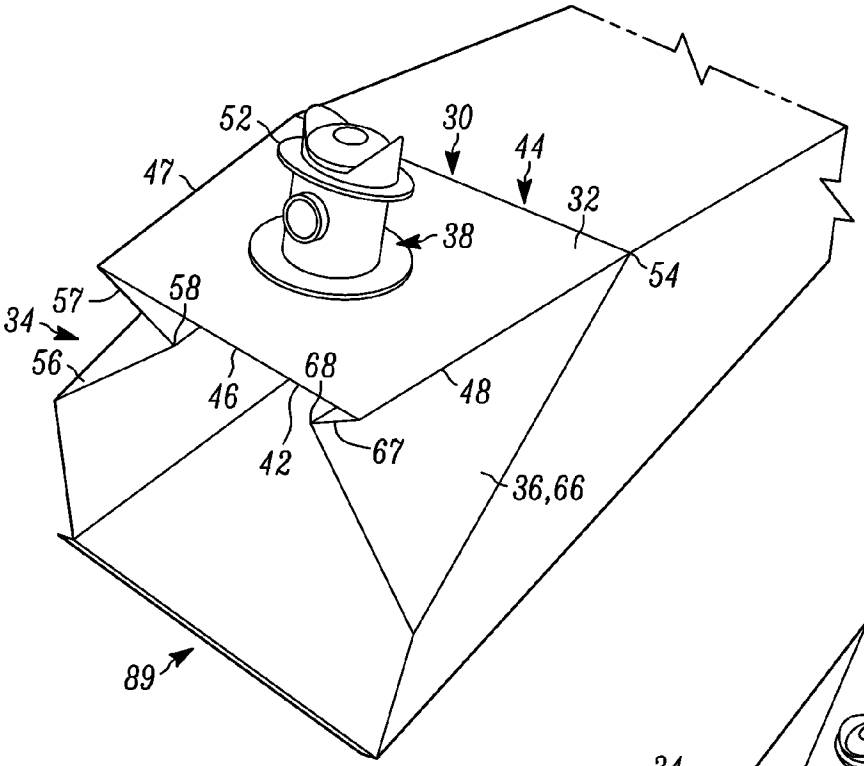
FIG. 6 of the drawings is a partial perspective view of a portion of the outer box of the present disclosure, showing, in particular, the articulatable portion.

The articulatable portion 30 is shown in FIGS. 6 through 8 as comprising front portion 32, first side webbing 34 and second side webbing 36. The articulatable portion 30 is integrally formed with the outer box 12, however, in other embodiments, this portion may be formed as separate components, or partially separate components that are coupled together and to the outer box (or, alternatively, to an inner sleeve). The front portion 32 includes outer surface 40 and inner surface 42. The outer surface and the inner surface are substantially parallel to each other, as the front portion preferably comprises a substantially planar portion of a corrugated paperboard material. The front portion 32 is generally defined by the top edge 44, the bottom edge 46, first side edge 47, second side edge 48 and locking flap portion 50. The first and second side edges extend inwardly toward each other generally symmetrically so that the bottom edge 46 is shorter than the top edge 44, with the top and bottom edges being substantially parallel to each other, and generally parallel to the bottom wall 28. The top edge is generally spaced apart from the top and bottom walls, and, generally is closer to the bottom wall, which then defines the height of the front portion 32.

The bottom edge has a width that is generally longer than the width of the portion of the tap 18 that is coupled thereto, so that the front portion 32 is of a generally trapezoidal configuration. A bottom locking flap 50 extends from the bottom edge and can be utilized to lock the front portion in the collapsed orientation. In other embodiments, the bottom locking flap 50 may be omitted, and, as will be explained below, reliance is placed upon the over-center geometric configuration to maintain the position of the articulated portion in a collapsed orientation.

It will be understood that the first side edge 47 intersects with the top edge 44 defining first upper corner 52. The second side edge 48 intersects with the top edge 44 defining second upper corner 54. It will be understood that each corner is configured to lie on the interfacing edge between the dispensing wall 24 and the respective first sidewall 20 and second sidewall 22. Opening 38 is disposed on the front portion and is sized so as to be spaced apart from the edges and to be configured to receive and retain the tap (as will be explained). The position of the opening is dependent on the size of the tap, the orientation of the tap in the closed orientation and the open orientation, and the dimensions of the outer box. It is desirable that when the container is in the shipping configuration (which will be defined below), the tap does not undesirably interfere with the other panels of the outer box, or with the outer cap, and also, that the tap is easily positioned into the articulated configuration.

The first side webbing 34 extends from the first side edge and couples with the first sidewall. Generally, the first side webbing is formed from portions that would otherwise have formed portions of the dispensing wall 24 and the first sidewall 20. In the embodiment shown, the first side webbing 34 includes first panel 56, second panel 57 and central fold 58. The first panel extends from the first sidewall 20 to the central fold 58. The second panel extends from the central fold 58 to the first side edge 47 of the front portion 32. The central fold 58, as well as the edge defined by the first panel 56 and the first sidewall 20 as well as the first side edge 47 all meet at the first upper corner 52 and extend generally oblique to each other from that corner. The fold at the first sidewall is generally oblique to the dispensing wall 24, and the first panel 56 is generally larger than the second panel 57, thereby providing an over-center mechanism. As such, the first and second panels 56, 57 are generally substantially triangular in configuration.

The second webbing 36 is a substantially mirror image of the first webbing 34 so that the front portion 32 pivots substantially uniformly at the top edge 44. Thus, the second side webbing is formed from portions that would otherwise have formed portions of the dispensing wall 24 and the second sidewall 22. In the embodiment shown, the second side webbing includes first panel 66, second panel 67 and central fold 68. The first panel extends from the second sidewall 22 to the central fold 68. The second panel extends from the central fold 68 to the second side edge 48 of the front portion 32. The central fold 68, as well as the edge defined by the first panel 66 and the second sidewall 22 as well as the second side edge 48 all meet at the second upper corner 54 and extend generally oblique to each other from that corner. The first and second panels 67, 68 are generally substantially triangular in configuration as with the first side webbing.

The fold at the first sidewall is generally oblique to the dispensing wall 24 and the second panel 66 is generally larger than the second panel 67, thereby providing an over-center mechanism as with the corresponding folds of the first side webbing. By having an over-center mechanism, the first and second side webbing act as springs that spring the front portion in the collapsed orientation, and retain such a configuration, and, also the articulated configuration. The spring force operates against sidewalls. It will be understood that by varying the shape and the relative size of the different webbing portions, the amount of force required to overcome the over-center mechanism can be varied. When articulating the front portion and the tap, the overcoming of the spring force can provide a tactile feel to the user.

More particularly, by varying the size of the first side webbing 34 and the second side webbing 36, and the position of the central fold (which, in turn, varies the size of each of the first and second panels 56, 57, 66, 67, a number of variations can be achieved with respect to the over-center mechanism. In particular, while rotating the front portion 32 relative to the top edge 44 thereof, it is possible to have the effective width of the articulatable portion 30 (which is defined by the configuration thereof relative to the edge wherein the first side webbing interfaces with the first sidewall and the second side webbing interfaces with the second sidewall) to reach a local maximum which is wider than the width of the dispensing wall 24. As such, further inward rotative movement requires the outward pushing of the first and second sidewalls by the articulatable portion. Once past this portion, the effective width is reduced from this relative maximum. When released, the rigidity of the first and second sidewalls maintains the front portion 32 at or near the relative maximum and in the collapsed position. In the contemplated embodiment, such a position is a stable position and force is required upon the front portion to cause movement and articulation of the front portion into the deployed orientation.

The outer cap 14 is shown in FIGS. 9 through 14 as comprising front wall 70, bottom wall 72, first sidewall 74, second sidewall 76 and back wall 78. It is contemplated that the outer cap 14 comprises a separate piece of material which is then coupled to the outer box. In the embodiment shown, the outer cap is dimensioned so as to follow the contours of the outer box, and to provide a continuous configuration thereto (i.e., continues the shape of the outer box to, for example, complete the rectangular cuboid configuration). The front wall 70 includes central opening 82 which is sized so as to allow a user to insert his or her fingers through the central opening to retrieve the tap, and also sized so as to allow the tap to extend therethrough. Thus, the position and size of the central opening is dependent, at least in part, on the configuration of the articulable portion 30 and the configuration of the tap. The central opening 82 may include a frangible opening extending thereover, which may be formed from any number of different materials.

Figure 9:
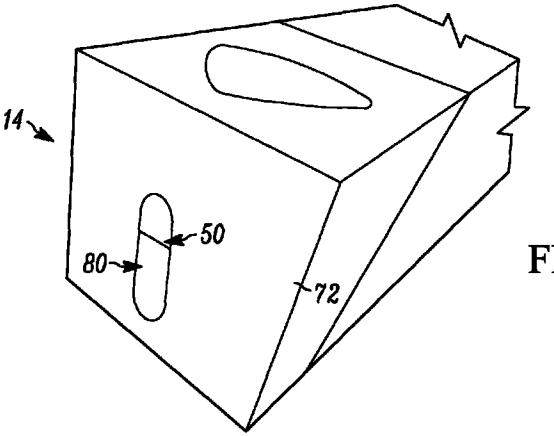
FIG. 9 of the drawings is a partial perspective view of the outer cap of the present disclosure, showing, in particular, the bottom wall thereof and the opening through which the locking flap is articulated.

With particular reference to FIG. 9, the bottom wall 72 includes opening 80 which provides ingress into the articulated portion. In embodiments that include some type of locking of the articulable portion in the collapsed configuration, the access through opening 80 permits unlocking of the same. In other embodiments, the additional opening can have different uses, or can be eliminated. The opening 80 may be covered with a frangible cover that may comprise the same corrugated material (i.e., the opening 80 is scored so that it can be easily punctured by a user).

Referring again to FIGS. 9 through 14, the first side wall 74 includes upper edge 86 which coincides with the edge defined by the first sidewall 20 and the first panel 56 of the first side webbing 34, so as to be generally complementary thereto. The second side wall 76 includes upper edge 88 which coincides with the edge defined by the second sidewall 22 and the first panel 66 of the second side webbing 36, so as to be generally complementary thereto. The back wall 78, in the embodiment shown, provides a relatively small lip 89 which provides additional structural rigidity to the overall configuration.

Figure 15:
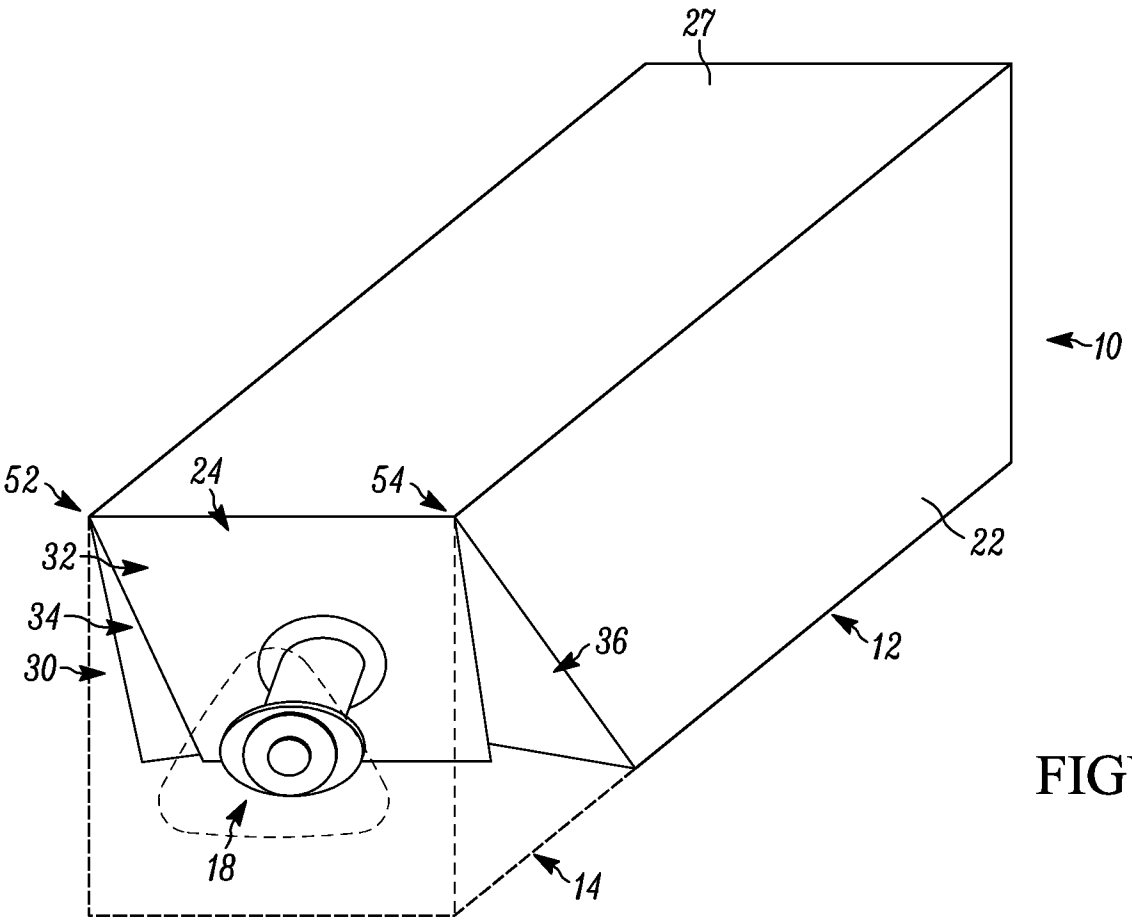
FIG. 15 of the drawings is a perspective view of another embodiment of the present disclosure, showing, in particular, a bag in box packaging with an outer box having an articulatable portion that is substantially encompassed entirely by the dispensing wall.

In another embodiment of the disclosure, shown in FIG. 15, the entire dispensing wall may form a part of the articulatable portion. Thus, the first upper corner 52 and the second upper corner 54 coincide with the corners wherein the dispensing wall meets with the top wall and the side walls. In particular, corner 52 may coincide with the corner where the top wall 27 meets with the first sidewall 20 and the dispensing wall 24. Similarly, corner 54 may coincide with the corner where the top wall 27 meets with the second sidewall 22 and the dispensing wall 24. In this manner, the top edge 44 coincides with the edge where the top wall meets the dispensing wall. Generally such a container has a depth that is greater than the height and the width (often termed a refrigerator pack). An outer cap (not shown) may be provided to cover the articulatable portion.

Figure 3:
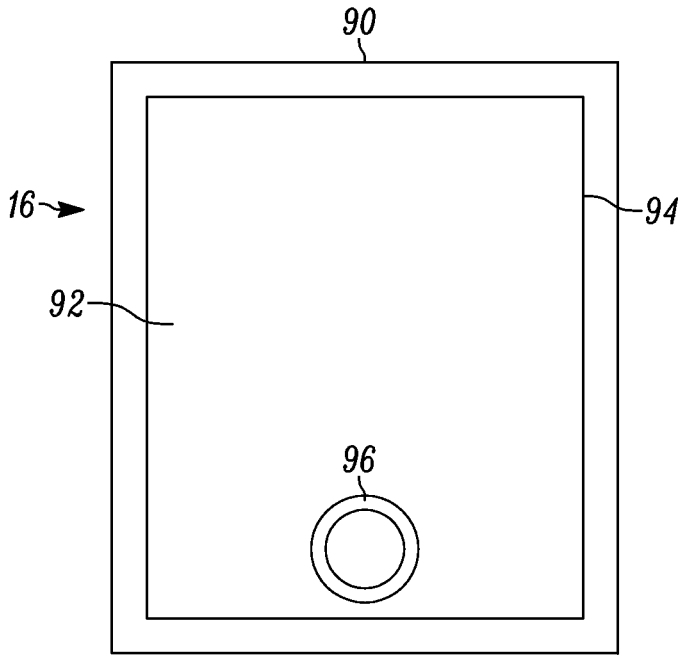
FIG. 3 of the drawings is a front elevational view of a bag for use in association with the bag in box packaging of the present disclosure.
Figure 4:
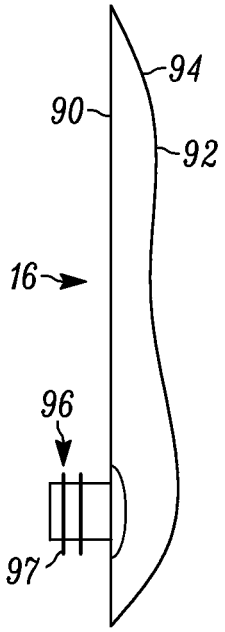
FIG. 4 of the drawings is a side elevational view of a bag for use in association with the bag in box packaging of the present disclosure.

With reference to FIGS. 3 and 4, the inner bag 16 generally comprises a pillow type container having a front panel 90, a back panel 92, seals 94 that couple the front panel to the back panel to define a generally rectangular or square cavity. A spout 96 is generally coupled to an opening in the front panel 90 so as to provide ingress into the cavity. Typically, the front and back panels may comprise a single or multi-layer laminate or co-extrusion, and may comprise a single or multi-ply configuration. In other embodiments, a gusseted bag, or other form fitting bag can be utilized in the place of a pillow type bag. The seals may be formed in any number of different manners. Additionally, the materials selected for each of the panels and the spout can be varied depending on the particular application.

Figure 5:
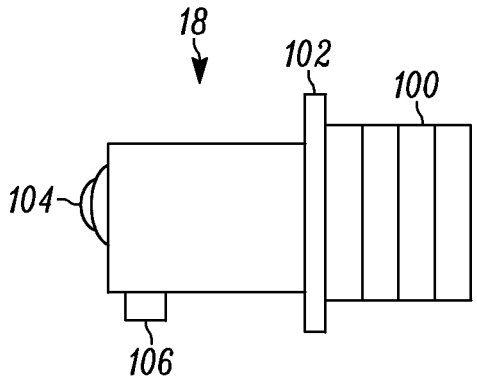
FIG. 5 of the drawings is a side elevational view of a tap for use in association with the bag in box packaging of the present disclosure.

The tap is shown in FIG. 5 as comprising a spout interface 100, flange 102, actuator 104 and dispensing opening 106. Any number of different configurations are contemplated for the tap, and the disclosure is not limited to any particular tap configuration, or any particular tap. For example, one such tap comprises the tap shown in any one of the following patents, namely, U.S. Pat. Nos. 4,619,377 and 6,978,981 both of which are issued to Roos as well as U.S. Pat. Nos. 6,045,119; 6,296,157 and 6,360,925 issued to Erb, as well as, the tap shown in U.S. Pat. No. 8,336,743 issued to Bellmore. Of course, other taps are likewise contemplated. The foregoing patents are incorporated by reference herein in their entirety.

With reference to FIGS. 1, 2 and 6 through 8, to assemble such a bag in box packaging, first the outer box is provided and articulated. The outer box is articulated so that the inner bag 16 can be introduced through the top or through the bottom. Generally, the bag will first be filled and the tap 18 will be interfaced with the spout 96 of the bag so as to seal the contents within the cavity of the bag. It will be understood that the disclosure is not limited to such a configuration. Indeed, in other embodiments, the inner bag may first be introduced and coupled to the outer box. Only then is the bag filled. In still other embodiments, the bag is first introduced, then filled, then the tap is coupled to the outer box and the bag thereby locking the three together.

The spout is interfaced with the opening 38 of the front portion 32 of the articulatable portion 30 and substantially locked thereto. Indeed, a number of different manners are known in which to lock the tap 18 to the front portion 32. Generally, the tap is maintained in place through the cooperation of the flange 102 of the tap cooperating with the flange 97 of the inner bag and the opening 38.

Once coupled, the front portion 32 is articulated toward the back wall 26 so as to articulate the first and second webbing 34, 36, so that the respective first and second panels overlie each other in substantial abutment, making the angle formed by the first and second panels at the corner fold smaller and smaller, with the outward faces facing each other. In such a configuration, the front portion 32 is articulated back generally as far as possible so as to remain in a stable configuration, so that the front portion is at as shallow of an angle as generally possible. In such a configuration, a substantially a z-shaped configuration is achieved between the first panel, the second panel and the front portion, with the front portion overlying a portion of the front portion of each of the first and second side webbing. In many embodiments, the second panel of each of the first and second side webbing is completely covered by the front portion.

More specifically, the front portion 32 is articulated relative to the top edge 44. As the front portion is articulated, the effective width of the articulatable portion relative to the side walls changes with the rotation. At a point in the rotation, the effective width is greater than the width of the dispensing wall between the first and second sidewalls. At such time, further rotation requires the bowing out of the side walls to accommodate the effective width. As further rotation occurs, the effective width reduces. To rotate back past this local maximum effective width, additional force is necessary to be applied to the front portion 32 so as to force the side walls outwardly. In such a configuration, the front portion is angled relative to the dispensing wall at an angle of approximately between 20° and 60°, although variations are contemplated (with the understanding that the tap that is utilized will be maintained in a footprint of the outer box when the front portion is in a collapsed orientation.

As will be understood, such a configuration creates as much space as generally possible (with the dimensions of the different portions of the articulatable portion controlling the relative effective width) when the outer cap 14 is positioned in the appropriate orientation. Once in this position, the locking flap 50 can be articulated so as to extend behind the first and second side webbing 34, 36. In turn, the first and second side webbings are sandwiched and captured by the front portion and the locking flap 50. The locking flap is maintained in position by the weight of the filled bag of flowable material. In other embodiments, the locking flap 50 may be omitted, and reliance can be made on the rigidity of the outer box configuration, so that the amount of force necessary to move past the local maximum effective width is provided and overcome.

Figure 11:
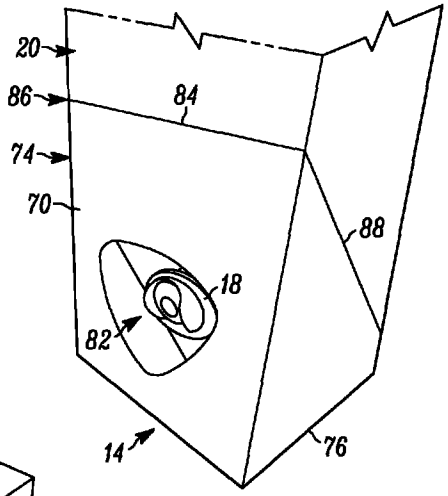
FIG. 11 of the drawings is a partial perspective view of the outer cap of the present disclosure, showing, in particular, the configuration thereof when the articulatable portion is in a collapsed configuration.
Figure 10:
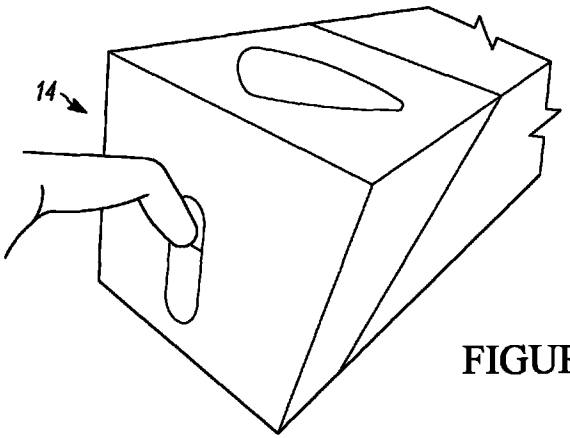
FIG. 10 of the drawings is a partial perspective view of the outer cap of the present disclosure, showing, in particular, the bottom wall thereof, and the user articulating the locking flap associated with the articulatable portion.

Next, and with reference to FIGS. 1 and 11 the outer cap 14 is positioned in place and coupled to the outer box 12. In the embodiment shown, the outer cap 14 is generally complementary to the outer box. Among other manners of attachment, the outer cap 14 can be attached to the outer box by having the upper edges 84, 86 and 88 glued to the outer box along the outer end of the respective first panels of the side webbings. In other embodiments, adhesive can be used in other areas. In still other embodiments, the outer cap can be integral with the outer box, and the articulatable portion can be a separate member that is coupled to the outer box in the proper configuration.

Once the outer cap is positioned in the proper orientation, the container is ready for use. With reference to FIGS. 9 through 14, sequentially, to utilize the container, the user is first provided a filled package 10 with the articulatable portion 30 in the collapsed orientation (i.e., the tap is positioned within the space defined by the articulatable portion and the outer cap). The user first extends his or her fingers through opening 80 and releases the locking flap 50. In certain embodiments, no locking flap is utilized, or another locking member is utilized. In certain embodiments, the user must remove a frangible cover to expose the opening 80 first. In other embodiments, no such locking flap is utilized.

Figure 13:
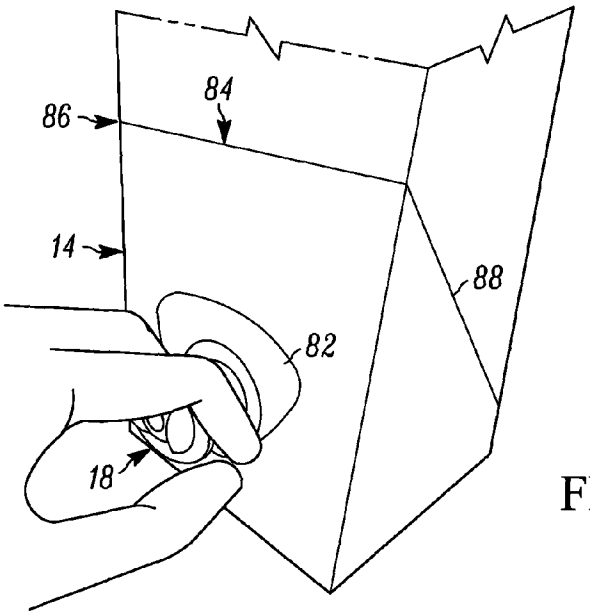
FIG. 13 of the drawings is a partial perspective view of the outer cap of the present disclosure, showing, in particular, the configuration thereof as a user continues to articulate the articulatable portion by way of actuation of the tap.
Figure 12:
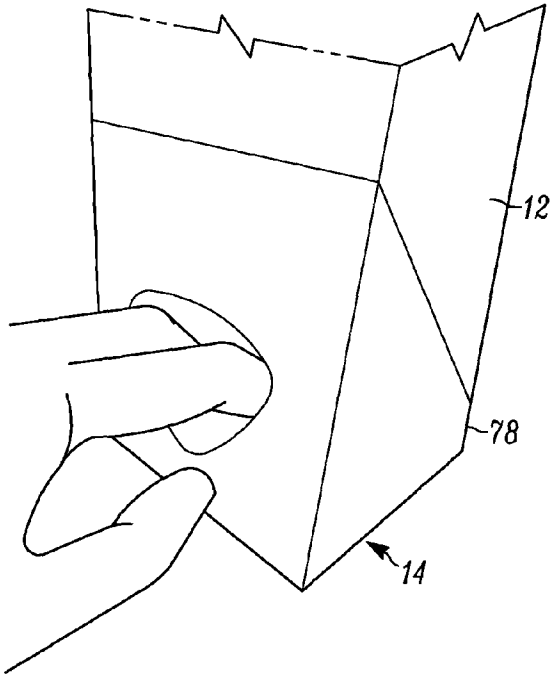
FIG. 12 of the drawings is a partial perspective view of the outer cap of the present disclosure, showing, in particular, the configuration thereof as a user reaches through the central opening of the front wall to retrieve the tap which is in the collapsed configuration.

With reference to FIGS. 11 through 14, once released, the user can begin to articulate the articulatable portion from the collapsed orientation to the articulated orientation. To achieve the same, the user first extends his or her fingers through the opening 38 to reach the tap 18. In certain embodiments, a frangible cover must first be moved out of the way, or removed. In other embodiments, no such frangible cover is utilized. Once the frangible cover has been negotiated, the user can reach through the opening 38 and grasp a portion of the tap 18 (FIG. 12). As is shown in FIG. 13, the tap can be pulled outwardly, which initiates the articulation of the articulatable portion 30 from the collapsed orientation toward the articulated orientation. Indeed, the user should feel overcoming the spring force created by the configuration of the side webbings and the over-center mechanism, as the front portion 32 extends beyond the local maximum effective width. Again, by varying the relative size of the side webbings, the force required to overcome the spring force as the local maximum effective width is reached, against the sidewalls can be varied.

Figure 14:
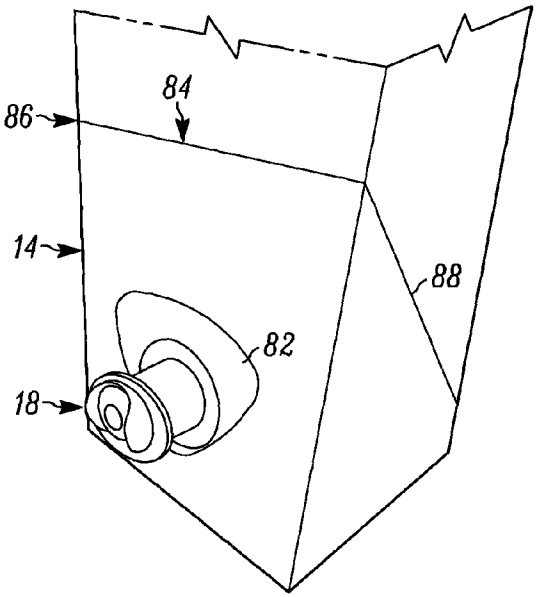
FIG. 14 of the drawings is a partial perspective view of the outer cap of the present disclosure, showing, in particular, the configuration thereof in an articulated configuration, such that the tap is ready to dispense flowable material from within the inner bag.

As is shown in FIG. 14, continued pulling of the tap rotates the front portion 32 until the front portion 32 abuts the front wall 70 of the outer cap 14. At such time, the tap extends through the opening 38 and is fully articulated, ready for dispensing. The front portion 32 is retained in the articulated orientation by the weight of the flowable material that is contained within the inner bag 16.

In such a configuration, the user can then utilize the actuator to dispense fluid from within the inner bag. If desired, and although not generally undertaken, the user can direct the tap back into the outer cap, and re-articulate the articulatable portion 30 back into the collapsed position if desired. The locking flap 50 can then be reintroduced to maintain the orientation. While such is possible, generally, once the tap has been articulated, the bag in box container stays in the articulated configuration.

The foregoing description merely explains and illustrates the invention and the invention is not limited thereto except insofar as the appended claims are so limited, as those skilled in the art who have the disclosure before them will be able to make modifications without departing from the scope of the invention.

What is claimed is:

1. A bag in box packaging comprising:

an outer box, the outer box having:

a top wall, a bottom wall, a first side wall, a second sidewall opposite the first sidewall, and a dispensing wall spanning between the top wall and the bottom wall, and spanning between the first sidewall and the second sidewall;

an articulatable portion hingedly coupled to each of the dispensing wall, the first sidewall and the second sidewall, the articulatable portion further including a front portion, a first side webbing and a second side webbing, the front portion extending from the dispensing wall and hinged thereto at a top edge, the first side webbing spanning between the first sidewall and the dispensing wall, and the second side webbing spanning between the second sidewall and the dispensing wall on the opposite side of the front portion, the first side webbing having a first panel and a second panel, the first panel joined to the first sidewall at a first edge, and joined to the second web at a central fold, the second panel joined to the front portion opposite the center fold at a second edge, the second side webbing having a first panel and a second panel, the first panel joined to the second sidewall at a first edge and joined to the second web at a central fold, the second panel joined to the front portion opposite the center fold at a second edge, whereupon inward rotation of the front portion, the first and second panels rotate about a respective one of the central folds with an outer surface of each of the first and second panels facing each other, with the articulated portion overlying a portion of the first panel of each of the first side webbing and second side webbing; and an inner bag having a plurality of panels that are sealed to form a substantially fluid tight cavity, with a spout coupled thereto to provide ingress into the cavity, and a tap coupled to the spout, wherein the inner bag is positioned within the outer box, and the tap is extended through an opening in the front portion of the articulatable portion so as to be accessible therefrom;

wherein the articulatable portion extends between an articulated configuration wherein the front portion of the articulatable portion is substantially coplanar with the dispensing wall to a collapsed orientation wherein the adjustable portion is inwardly rotated so as to be oblique to the dispensing wall; and wherein the articulatable portion defines an effective width whereupon rotation of the articulatable portion from the articulated configuration to the collapsed orientation increases the effective width until the effective width is wider than a distance between the first side wall and the second sidewall proximate the articulatable portion, defining a local maximum width, whereupon further inward rotation outwardly forces at least one of the first and second side walls until the effective width is less than or equal to the distance between the first side wall and the second side wall.

2. The bag in box packaging of claim 1 further comprising an outer cap coupled to the outer box so as to cover the articulatable portion from the collapsed orientation to the articulated configuration, with an opening to receive the tap when in the articulated configuration.

3. The bag in box packaging of claim 1 wherein the first and second side wall maintains the articulatable portion in a collapsed orientation proximate a local maximum width.

4. The bag in box packaging of claim 1 wherein at a local maximum width, the front portion of the articulatable portion is angled relative to the dispensing wall at an angle of approximately between 20° and 60°.

5. The bag in box packaging of claim 1 wherein front portion of the articulatable portion defines a trapezoidal configuration.

6. The bag in box packaging of claim 1 wherein the first edge of the first side webbing, the central fold of the first side webbing and the second edge of the first side webbing and the top edge of the front portion meet at a corner.

7. The bag in box packaging of claim 6 wherein the first edge of the second side webbing, the central fold of the second side webbing and the second edge of the second side webbing and the top edge of the front portion meet at a corner.

8. The bag in box packaging of claim 7 wherein the first side webbing and the second side webbing are substantially identical mirror images of each other.

9. The bag in box packaging of claim 8 wherein the tap is positioned centrally on the front portion of the articulatable portion between the first side webbing and the second side webbing.

10. The bag in box packaging of claim 1 wherein the articulatable portion is formed from portions of the first sidewall, second sidewall and the dispensing wall.

11. The bag in box packaging of claim 10 wherein the articulatable portion is formed from substantially the entirety of the dispensing wall.

12. The bag in box packaging of claim 1 wherein the front portion further includes a locking flap extending from a bottom edge thereof, the locking flap configured to extend over an inner surface of the first side webbing and the second side webbing, so as to maintain a collapsed configuration.

13. An outer box for a bag in box packaging comprising:

a top wall, a bottom wall, a first side wall, a second sidewall opposite the first sidewall, and a dispensing wall spanning between the top wall and the bottom wall, and spanning between the first sidewall and the second sidewall; and an articulatable portion hingedly coupled to each of the dispensing wall, the first sidewall and the second sidewall, the articulatable portion further including a front portion, a first side webbing and a second side webbing, the front portion extending from the dispensing wall and hinged thereto at a top edge, the first side webbing spanning between the first sidewall and the dispensing wall, and the second side webbing spanning between the second sidewall and the dispensing wall on the opposite side of the front portion, the first side webbing having a first panel and a second panel, the first panel joined to the first sidewall at a first edge, and joined to the second web at a central fold, the second panel joined to the front portion opposite the center fold at a second edge, the second side webbing having a first panel and a second panel, the first panel joined to the second sidewall at a first edge and joined to the second web at a central fold, the second panel joined to the front portion opposite the center fold at a second edge, whereupon inward rotation of the front portion, the first and second panels rotate about a respective one of the central folds with an outer surface of each of the first and second panels facing each other, with the articulated portion overlying a portion of the first panel of each of the first side webbing and second side webbing, wherein the articulatable portion extends between an articulated configuration wherein the front portion of the articulatable portion is substantially coplanar with the dispensing wall to a collapsed orientation wherein the adjustable portion is inwardly rotated so as to be oblique to the dispensing wall, and wherein the articulatable portion defines an effective width whereupon rotation of the articulatable portion from the articulated configuration to the collapsed orientation increases the effective width until the effective width is wider than a distance between the first side wall and the second sidewall proximate the articulatable portion, defining a local maximum width, whereupon further inward rotation outwardly forces at least one of the first and second side walls until the effective width is less than or equal to the distance between the first side wall and the second side wall.

14. The outer box of claim 13 wherein the articulatable portion is formed from a portion of each of the first sidewall, the second sidewall and the dispensing wall.

15. The outer box of claim 13 wherein the front portion includes an opening spaced apart from the top edge and the second side edges, the opening configured to receive at least one of a spout and a tap.

16. The outer box of claim 13 further comprising an outer cap removably positionable over the articulatable portion, and coupled to the outer box, the outer cap having an opening on a front wall thereof configured to provide access to a tap positioned therein.

17. The outer box of claim 13 wherein the first and second side wall maintains the articulatable portion in a collapsed orientation proximate a local maximum width.

18. The outer box of claim 13 wherein at a local maximum width, the front portion of the articulatable portion is angled relative to the dispensing wall at an angle of approximately between 20° and 60°.

* * * * *